US008452224B2

(12) United States Patent
Ishioka

(10) Patent No.: US 8,452,224 B2
(45) Date of Patent: May 28, 2013

(54) SHEET CONVEYANCE APPARATUS HAVING MOVABLE GUIDE RIBS AND IMAGE FORMING APPARATUS

(75) Inventor: Naoki Ishioka, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 12/750,365

(22) Filed: Mar. 30, 2010

(65) Prior Publication Data

US 2010/0254734 A1 Oct. 7, 2010

(30) Foreign Application Priority Data

Apr. 2, 2009 (JP) ..... 2009-090171

(51) Int. Cl.
*B65H 29/52* (2006.01)

(52) U.S. Cl.
USPC ..... 399/405; 399/397; 399/16

(58) Field of Classification Search
USPC ..... 399/405, 397, 16; 271/264; 400/642
See application file for complete search history.

(56) References Cited

FOREIGN PATENT DOCUMENTS

JP 2004345746 A * 12/2004
JP 2008-120568 5/2008

* cited by examiner

*Primary Examiner* — Judy Nguyen
*Assistant Examiner* — Jennifer Simmons
(74) *Attorney, Agent, or Firm* — Canon USA Inc IP Division

(57) ABSTRACT

A sheet conveyance apparatus includes a first roller and a second roller. The second roller is urged to the first roller by an elastic member. In the sheet conveyance apparatus, sheet guide rib is provided which can project into a sheet conveyance path formed by a sheet guide plate. The sheet conveyance apparatus further includes an interlock portion which is mechanically interlocking with a changing position of the second roller, and changes the projecting amount of the sheet guide rib into the sheet conveyance path such that the more the thickness of a sheet increases, the smaller the projecting amount becomes.

14 Claims, 12 Drawing Sheets

SHEET CONVEYANCE APPARATUS HAVING MOVABLE GUIDE RIBS AND IMAGE FORMING APPARATUS

BACKGROUND OF THE INVENTION

1. Field of the Invention

The present invention relates to a sheet conveyance apparatus used in an image forming apparatus, such as a copying machine, a printer, or a facsimile, and also relates to an image forming apparatus including this sheet conveyance apparatus.

2. Description of the Related Art

Conventionally, the sheet conveyance apparatus applied to an image forming apparatus conveys a sheet along a sheet conveyance path formed by a pair of sheet guide plates facing to each other. When a thin sheet is conveyed in this sheet conveyance apparatus, the sheet tends to stick to the guide plates due to water vapor or static electricity. Particularly, immediately after a toner image is thermally fixed, since a lot of water vapor is produced from the sheet, the sheet has a high chance of sticking to the sheet guide plates. To prevent the sheet from sticking to the sheet guide plates, a contact area between the sheet and the sheet guide plate needs to be reduced. Therefore, a sheet conveyance apparatus provided with protrusions from the sheet guide plates (sheet guide ribs) has been devised.

Meanwhile, when a thick sheet is conveyed in the sheet conveyance apparatus provided with the sheet guide ribs, there is a possibility that a sheet gets scratched by the ribs or an image formed on the sheet is distorted.

As a consequence, a sheet conveyance apparatus has been developed which can adjust projecting amounts of the sheet guide ribs to deal with thin and thick sheets (Japanese Patent Application Laid-Open No. 2008-120568).

However, in the sheet conveyance apparatus according to Japanese Patent Application Laid-Open No. 2008-120568, when adjusting the projecting amount, a user is required to set and input a thickness of a sheet to be conveyed. Therefore, substantial time and labor is required in performing settings, so that setting errors and forgetting are likely to occur.

Another problem is that a drive source needs to be provided for a device to adjust the projecting amount of the sheet guide ribs, which is likely to increase the size of the apparatus.

SUMMARY OF THE INVENTION

The present invention is directed to a sheet conveyance apparatus and an image forming apparatus which do not require the user to set and input a thickness of a sheet, and enable the user to adjust an amount of projection of sheet guide ribs into a sheet conveyance path.

The present invention is directed to a sheet guide rib projection amount adjusting unit and an image forming apparatus, which obviate the need to provide a drive source for the rib projection amount adjusting unit and can adjust an amount of projection of the sheet guide ribs by a simple mechanism.

A sheet conveyance apparatus according to the present invention includes (A) a sheet conveyance roller pair including a first roller and a second roller. The second roller is urged to the first roller by an elastic member. The sheet conveyance roller pair conveys a sheet by nipping the sheet between the first roller and the second roller, and changes the position of the second roller according to a thickness of a sheet being conveyed by the sheet conveyance roller pair against an urging force of the elastic member, (B) a sheet guide plate provided on the downstream from a sheet conveyance roller pair in a sheet conveyance direction facing to each other to form a sheet conveyance path to convey the sheet, (C) a sheet guide rib provided on the downstream from the sheet conveyance roller pair in the sheet conveyance direction, and the sheet guide rib is provided to project into the sheet conveyance path from the sheet guide plate and their projecting amount can be changed, and (D) an interlock portion mechanically interlocking with a changing position of the second roller which changes the projecting amount of the sheet guide rib into the sheet conveyance path such that the more thickness of a sheet increases, the smaller the projecting amount becomes.

According to the present invention, a sheet can be conveyed by adjusting an amount of projection of sheet guide ribs into a sheet conveyance path without setting a sheet thickness by a user. A drive source to adjust the lower guide ribs need not be provided and the projecting amount of the lower guide ribs can be adjusted by a simple mechanism.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A sheet conveyance apparatus 10 according to a first exemplary embodiment and an image forming apparatus 60 are described with reference to FIGS. 1 to 10.

Figure 10:
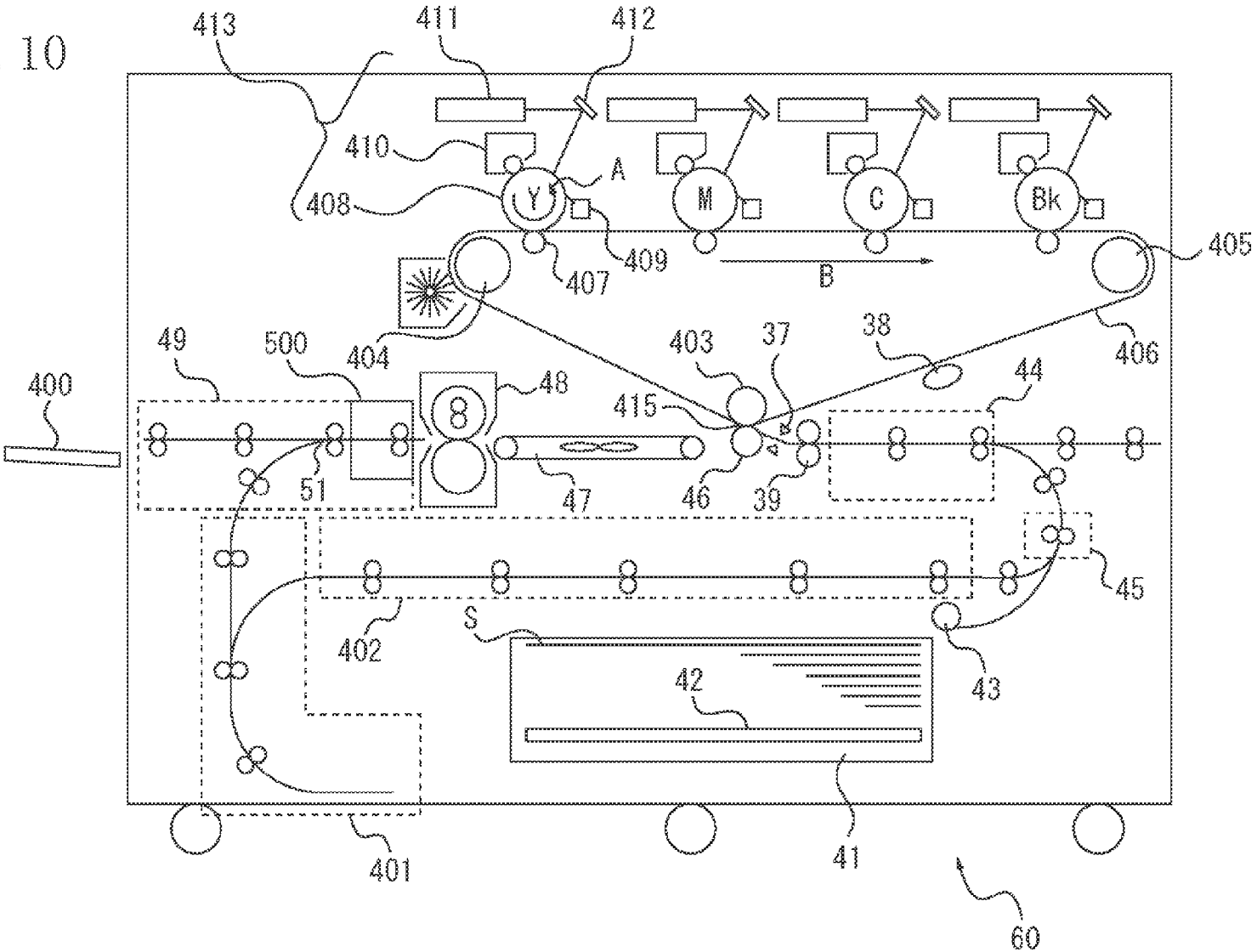
FIG. 10 is a sectional view of an exemplary embodiment of the present invention.

FIG. 10 is a sectional view of a color image forming apparatus 60 as an exemplary embodiment of the image forming apparatus 60 according to the present invention. Referring to FIG. 10, a general structure of the image forming apparatus is described.

An image forming apparatus 60 is a tandem-type color image forming apparatus, which includes different photosensitive drums 408 arranged in parallel for different colors to be developed, namely, yellow (Y), magenta (M), cyan (CC), and black (K). The parts provided around each photosensitive drum 408 are a cleaning member 409, an electric charger (not illustrated), an exposure device 411, a developing unit 410, an intermediate transfer belt 406, and a primary transfer unit 407. A secondary transfer unit 415 includes secondary transfer units 46 and 403 used to transfer a developer image from the intermediate transfer belt 406 to a sheet S. Those process units, along with the photosensitive drum 408, constitute an image forming section 413 to form and transfer a developer image to a sheet S.

A sheet feeding/storing unit 41, which is provided at a lower portion of the image forming apparatus 60, receives and stores sheets S on the lift up device mounted in the sheet feeding/storing unit 41. The image forming apparatus 60 includes a sheet feeding unit 43 and a conveyance unit 44, which serve as sheet feeding devices to convey a sheet S from the sheet feeding/storing unit 41 to the secondary transfer section 415. Those sheet feeding devices can feed sheets of different kinds with different thickness.

An image forming operation to form a developer image and transfer it to a sheet S is performed by the image forming section 413.

Each photosensitive drum 408 is rotated in a direction of arrow A by a motor (not illustrated). A residual developer on the surface of the photosensitive drum 408 is removed by the cleaning member 409. Then, a surface of the photosensitive drum 408 is uniformly charged by an electric charger (not illustrated). The surface of the photosensitive drum 408 is exposed with light according to image information by the exposure unit 411, and an electrostatic latent image is formed on the surface of the photosensitive drum 408. The electrostatic latent image is visualized into a developer image by causing a developer to adhere to the photosensitive drum 408 by the development unit 410. The primary transfer unit 407 sequentially transfers a developer image on the photosensitive drum 408 to the intermediate transfer belt 406 rotating in a direction of arrow B. Four-color developer images are superimposed on the intermediate transfer belt 406 and conveyed to the secondary transfer section 415. The developer image is transferred by the secondary transfer units 46, 403 onto a sheet S, which is fed to the secondary transfer section 415 at timing of the above-described operation by the sheet feeding roller 43 and the conveyance unit 44

The developer image formed on the sheet S as described above is thermally fixed by a fixing unit 48.

The sheet S on which the image has been fixed passes through a discharge unit 49 and is discharged to a discharge tray 400. Alternately, if images are formed on two sides of the sheet S, the sheet is conveyed to a reversing conveying unit 401 where a leading edge and a trailing edge of a traveling direction of the sheet are reversed, and the reversed sheet is conveyed to a two-sided transfer unit 402 which conveys the reversed sheet S to a junction point between the sheet transfer apparatus and the feeding/storing unit 41. An image is formed on a side of the sheet behind a side on which an image has been formed, and the sheet is discharged to the discharge tray 400.

A sheet conveyance apparatus 10 according to this exemplary embodiment is described with reference to FIGS. 1 to 5. In this embodiment, a sheet conveyance apparatus 10 is arranged in a position 500 close to the fixing unit 40 susceptible to the influence of water vapor produced from a sheet S by heat generation of the fixing unit 40. The position 500 in FIG. 10 is located between the sheet conveyance path leading to the discharge tray 400 and the sheet conveyance path leading to the reversing conveying unit 401.

Figure 1:
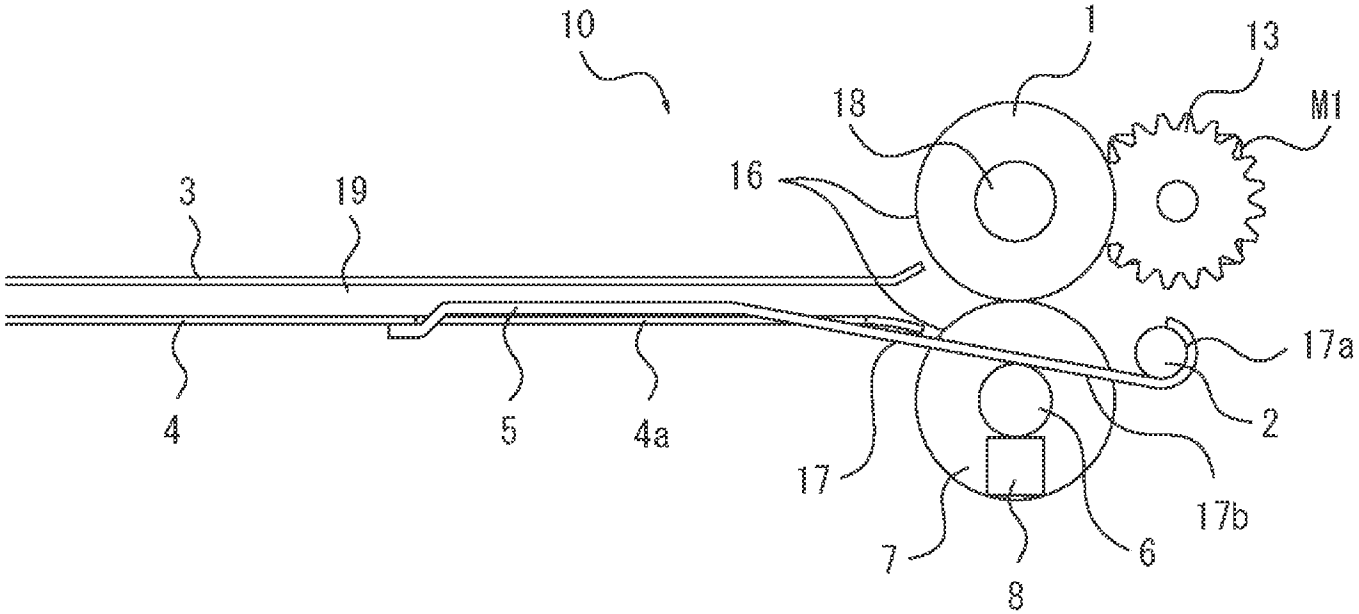
FIG. 1 is a sectional view of a first exemplary embodiment of a sheet conveyance apparatus according to the present invention.

FIG. 1 is a sectional view of the sheet conveyance apparatus 10. The sheet conveyance apparatus 10 includes a sheet conveyance roller pair 16, a conveyance upper guide plate 3 as a first sheet guide plate, a conveyance lower guide plate 4 as a second sheet guide plate, a lower guide rib 5 as a sheet guide rib, and a lever 17 as an interlock portion. The sheet conveyance apparatus 10 conveys a sheet by holding a sheet by a pair of the sheet conveyance rollers 16 through a sheet conveyance path 19 formed by the conveyance upper guide 3 and the conveyance lower guide plate 4.

The sheet conveyance roller pair 16 consists of a drive roller 1 as a first roller and a driven roller as a second roller. As shown in FIG. 1, a rotation drive force of a motor M1 is transmitted to a drive roller 1 through a gear 13 to rotatably drive the drive roller 1. The sheet is conveyed sandwiched (nipped) by the drive roller 1 and the driven roller 7, which is driven by the drive roller 1.

A position of the rotational axis of the drive roller 1 (drive roller rotational axis 18) is fixed by a support plate (not illustrated). On the other hand, a position of the rotational axis of the driven roller 7 (driven roller rotational axis 6) is supported by long holes bored in the support plate (not illustrated) and can be displaced. Therefore, the driven roller 7 can be attached and detached to and from the drive roller 1. The driven roller rotational axis 6 is pressed by a pressure spring 8 as an elastic member in a direction urging the driven roller 7 to come into contact with the drive roller 1.

Because the sheet conveyance roller pair 16 is structured as described, as a sheet S passes through the pair of sheet conveyance rollers 16, the driven roller 7 is displaced in a direction of separating from the drive roller 1 by an amount of the thickness of a sheet in defiance of an urging force of the pressure spring 8, so that a gap between the driven roller 7 and the drive roller 1 changes. At the same time, the driven roller rotational axis 6 also moves in a direction of separating from the drive roller rotational axis 18. The more the thickness of a sheet increases, the greater will be the amount of movement.

Figure 4:
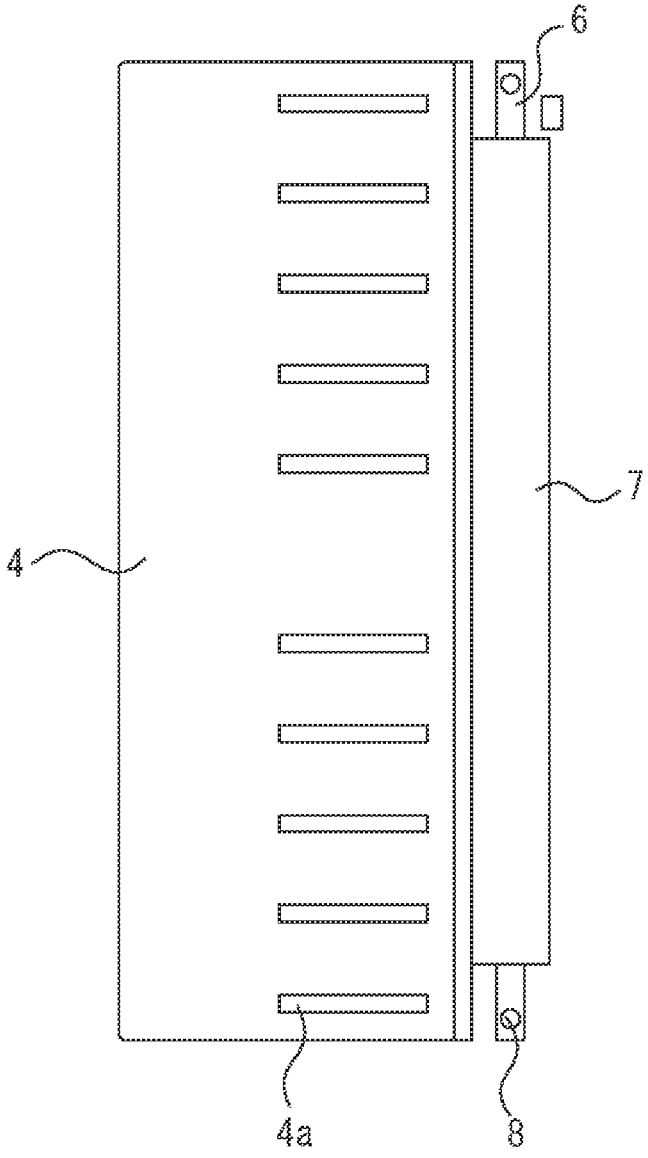
FIG. 4 is a bottom view of the sheet conveyance apparatus with sheet guide ribs removed.

The sheet conveyance path 19 is formed by the conveyance upper guide plate 3 and the conveyance lower guide plate 4, which are provided facing to each other, downstream from the sheet conveyance roller pair 16 in the sheet conveyance direction. The gap of the sheet conveyance path 19 is set to such an extent that a thick sheet can pass to enable conveyance of sheets S of different thickness. When conveyed by the sheet conveyance roller pair 16, a sheet S passes through the sheet conveyance path 19. The conveyance lower guide plate 4 has a plurality of holes 4*a* formed therein (10 holes in FIG. 4) to allow the lower guide ribs 5 to come into and out of the sheet conveyance path 19. The lower guide ribs 5 will be described below. The holes 4*a* are elongate and extend in the sheet conveyance direction. The holes 4*a* penetrate the conveyance lower guide plate 4 in a through-thickness direction and are arranged side by side perpendicular to the sheet conveyance direction (FIG. 4).

Figure 5:
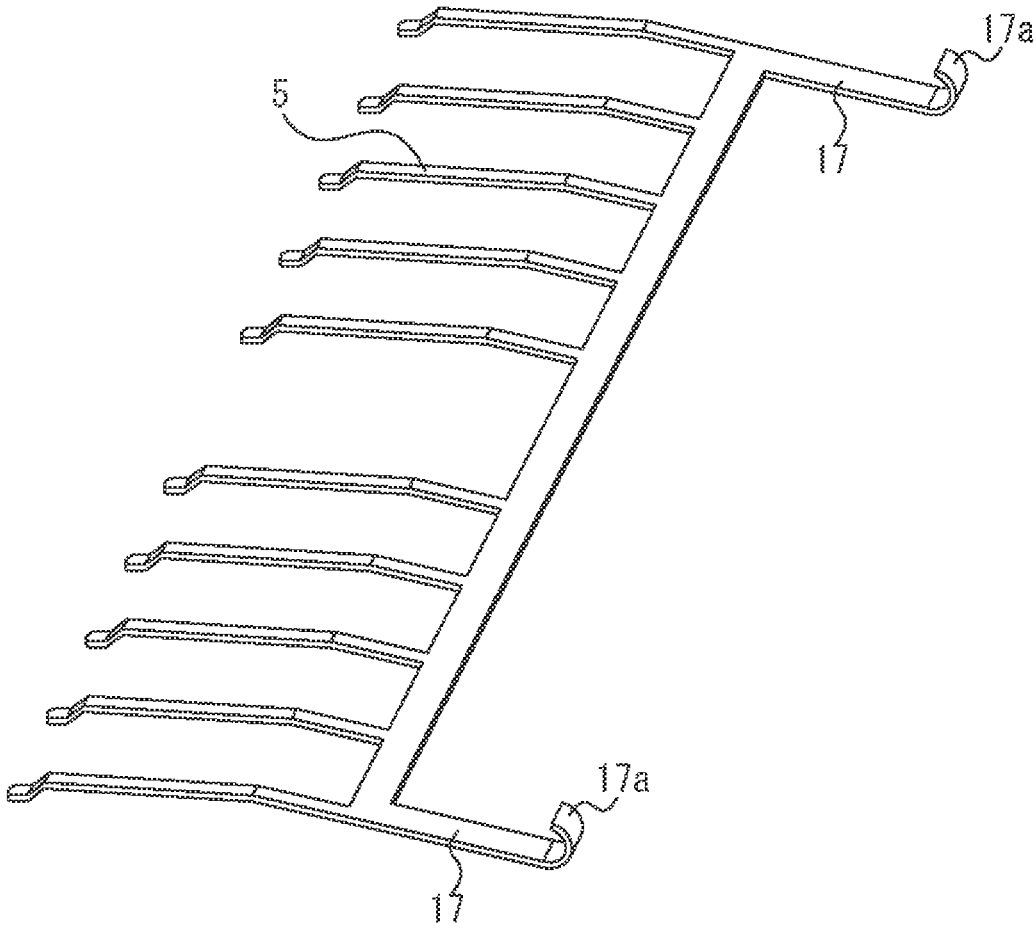
FIG. 5 is a perspective view of sheet guide ribs and levers to be applied to the sheet conveyance apparatus according to the present invention.
Figure 6:
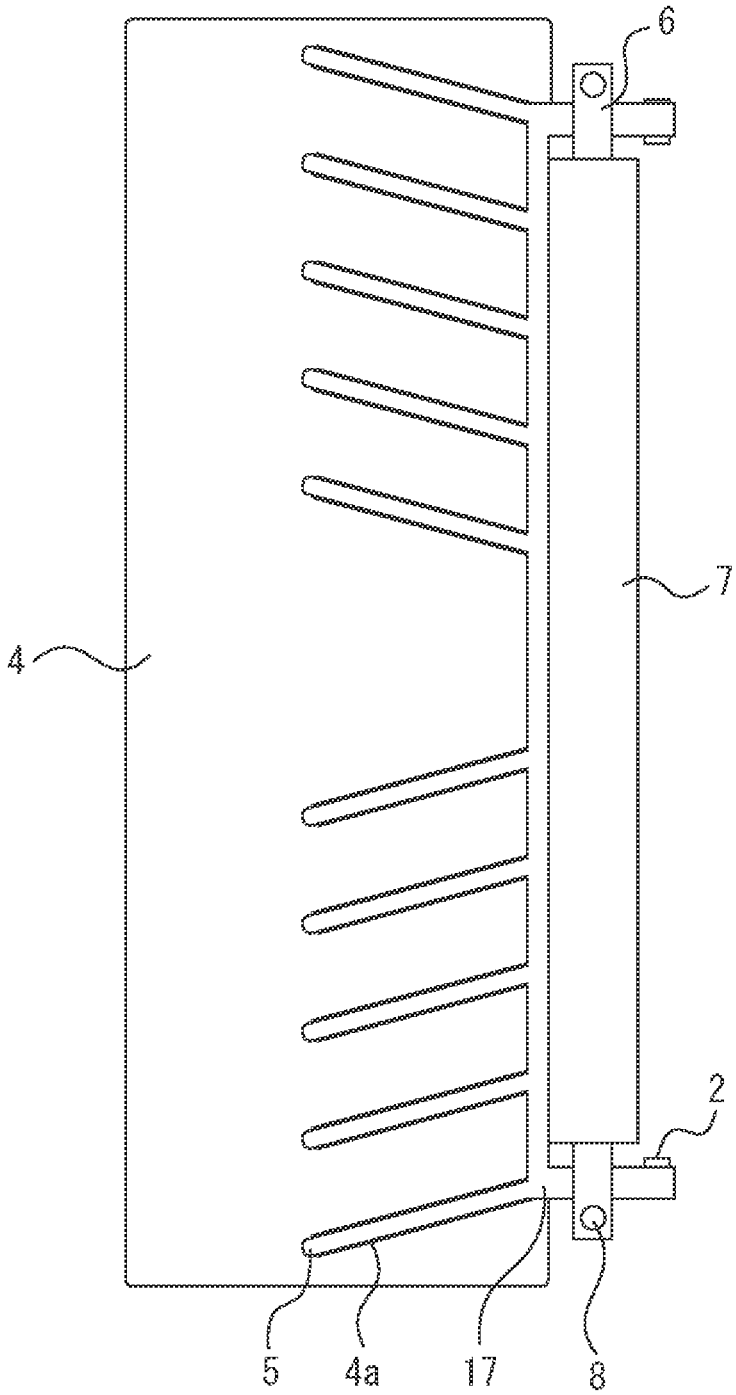
FIG. 6 is a bottom view of the sheet conveyance apparatus to which a modification of the sheet guide plate illustrated in FIG. 4 is applied.

The lower guide ribs 5 and the lever 17 as an interlock part are described in the following. As illustrated in FIG. 5, a plurality of the lower guide ribs 5 are fixed to the lever 17 in such a manner as to extend from the lever 17. The lower guide ribs 5 can protrude through the holes 4*a* into the sheet conveyance path. When a sheet has not been conveyed into the sheet conveyance path as illustrated in FIG. 1, the lower guide ribs extend from the holes 4*a* of the conveyance lower guide plate 4. As illustrated in FIGS. 4 and 5, the lower guide ribs 5, and the holes 4*a* which allow the lower guide ribs 5 to come into and out of the sheet conveyance path 19, are provided in parallel, but the lower guide ribs 5 and the holes 4*a* may be arranged in broadening directions relative to the sheet conveyance direction as illustrated in FIG. 6.

As illustrated in FIG. 1, each lever support shaft engaging part 17*a* is provided at an end portion on one side of the lever 17 which is not coupled to the lower guide ribs 5. The lever 17 is attached to two lever support shafts 2 provided at end portions in the longitudinal direction of the sheet conveyance roller pair 16 on the upstream side of the sheet conveyance direction from the sheet conveyance roller pair 16 so that the lever 17 can grapple the lever support shaft engaging part 17*a*. The lever 17 is mounted rotatably about the lever support shaft 2, and the lever 17 engages, at the driven roller engaging part 17*b*, with the driven roller rotational axis 6 and is supported by the rotational axis 6. Thus, the lever 17 rotates about the lever support shaft 2 as the fulcrum point along with the driven roller rotational axis 6 which is displaced as above mentioned. Concurrently with the rotation of the lever 17, the lower guide ribs also rotate integral with the lever 17 and, therefore, the projecting amount (a projecting height from the holes 4*a*) into the sheet conveyance path 19 can be changed.

In the sheet conveyance apparatus 10 configured as described, when a sheet S starts to pass through the pair of the sheet conveyance roller pair 16 and the position of the driven roller 7 changes, the lever 17 rotates interlocking with the changing position of the driven roller 7. Then, the lower guide ribs 5, which are fixed extending downstream from the lever 17 in the sheet conveyance direction, rotates in a direction reducing the projecting amount into the sheet conveyance path 19.

Next, cases where a thin sheet or a thick sheet is conveyed in the sheet conveyance apparatus 10, are described.

Figure 2:
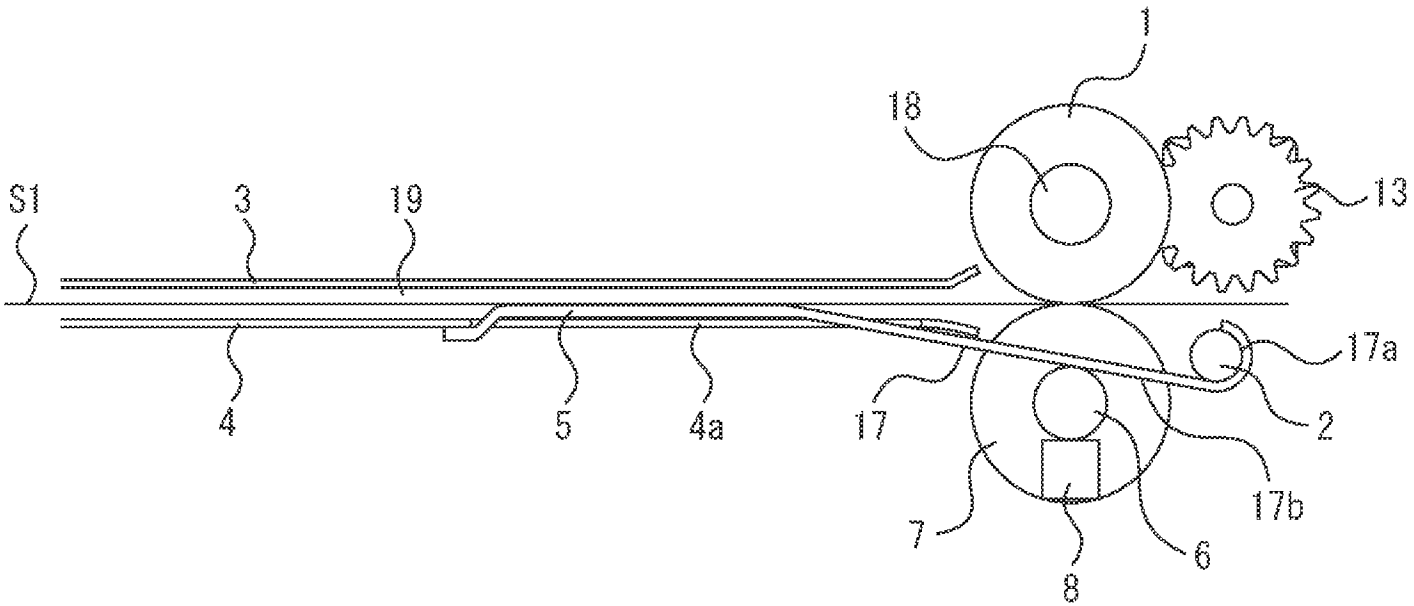
FIG. 2 illustrates a state in which a thin sheet has been conveyed in a sheet conveyance path by a sheet conveyance apparatus.

When a thin sheet S1 (0.1 mm thick, for example) is conveyed, the driven roller 7 moves in a direction of getting away from the drive roller 1 by an amount of the thickness of the thin sheet S1 as illustrated in FIG. 2. Accordingly, the lever 17 is rotated, thereby reducing the projecting amount of the lower guide ribs 5 into the sheet conveyance path 19. However, in the case of a thin sheet S1, since the amount of movement of the driven roller rotational axis 6 is very small, an amount of retraction of the lower guide ribs 5 from the sheet conveyance path 19 is very little. Therefore, when passing through the sheet conveyance path 19, the thin sheet S1 contacts the lower guide ribs 5. Because the sheet S1 is guided through the sheet conveyance path 19 by the lower guide ribs 5, friction resistance is small, and a thin sheet S1 can be conveyed smoothly. Therefore, a possibility of a sheet S1 sticking to the upper and lower conveyance guide plates 3,4 can be reduced.

Figure 3:
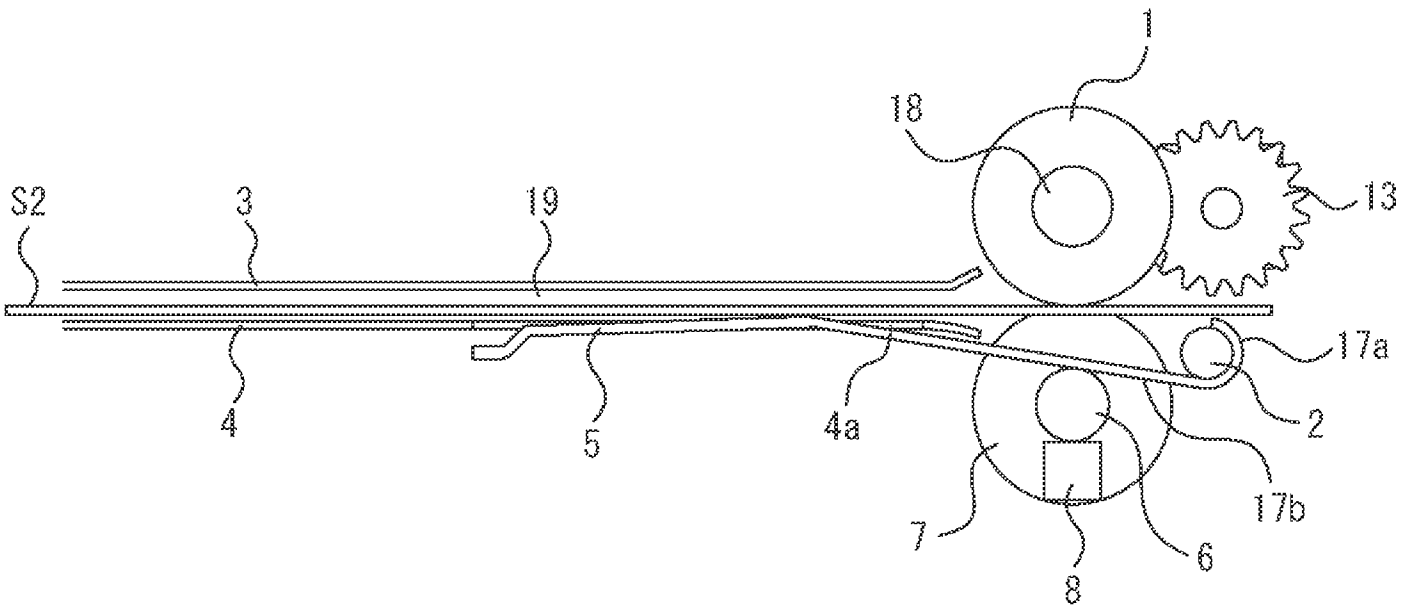
FIG. 3 illustrates a state in which a thick sheet has been conveyed in the sheet conveyance path by the sheet conveyance apparatus.

On the other hand, when a thick sheet S2 (0.35 mm thick, for example) is conveyed, similar to the case of a thin sheet S1, as the lever 17 is rotated by a positional change of the driven roller 7, the lower guide ribs 5 rotates in a direction of retracting from the sheet conveyance path 19. As illustrated in FIG. 3, since the lower guide ribs rotate by a large amount, the projecting amount of the lower guide ribs 5 to the sheet conveyance path 19 is small. In other words, the amount of contact between the thick sheet S2 and the lower guide ribs is small, causing the thick sheet S2 to contact the conveyance lower guide plate 4. In this case, because the thick sheet S2 contacts not only the lower guide ribs 5 but also the conveyance lower guide plate 4, a force applied to the thick sheet S2 is dispersed. Therefore, chances that the lower guide ribs scratch the sheet S and a formed image is distorted can be reduced. Even if a contact area becomes wide when the sheet contacts both the lower guide ribs 5 and the conveyance lower guide plate 4, because the thick sheet S2 has an excellent resistance to tearing, there is little possibility that a thick sheet S2 sticks to the lower guide ribs and the conveyance lower guide plate 4 and sheet conveyance is stopped.

As described above, this embodiment is configured such that a sheet S2 slightly contacts the lower guide ribs 5 when a thick sheet S2 is conveyed. However, this embodiment may also be configured to prevent a sheet S2 from contacting the lower guide ribs by retracting the lower guide ribs 5 from the sheet conveyance path completely when a sheet thicker than a predetermined thickness (0.35 mm or more, for example) is conveyed. Under this condition, a sheet S2 slightly rubs a substantially flat surface of the conveyance lower guide plate 4, which prevents the sheet from being scratched and an image from being distorted.

As described above, this embodiment is configured to change the projecting amount of a sheet, mechanically interlocking with the position of the driven roller 7, such that the projecting amount of the lower guide ribs 5 into the sheet conveyance path 19 becomes smaller as the thickness of a sheet increases. Thus, it becomes unnecessary for a user to set and input a thickness of a sheet and it is possible to convey various sheets of different thickness.

In an image forming apparatus, which can in a mix mode continuously form images by feeding sheets of different thickness, the sheets can be conveyed by a lower-guide-rib projecting amount suitable to individual sheet thickness.

Further, a drive source to adjust the lower guide ribs 5 need not be provided and the projecting amount of the lower guide ribs 5 can be adjusted by a simple mechanism.

In this embodiment, it is arranged that the projecting amount of the lower guide ribs 5 into the sheet conveyance path 19 is changed by a lever mechanism, which includes the lever support shaft 2 provided as the fulcrum upstream from the sheet conveyance roller pair 16 in the sheet conveyance direction, the driven roller engaging part 17*b* as the point of the lever where force is applied, and the downstream side from the sheet conveyance roller pair 16 in the sheet conveyance direction as the point of load. Under this arrangement, the projecting amount of the lower guide ribs can be changed greatly even when a difference in sheet thickness is small.

As described above, the sheet conveyance apparatus 10 is mounted in a position 500 on the downstream side from the fixing unit 48 in the sheet conveyance direction. As described above, a sheet S is highly likely to stick to the guide plates 3, 4 due to water vapor on the downstream side from the heating type fixing unit 48 in the sheet conveyance direction. For this reason, mounting the sheet conveyance apparatus 10 at the above-mentioned position is effective to prevent sticking of a sheet.

If the sheet conveyance apparatus 10 is applied to the downstream side from the fixing unit 48 in the conveyance unit 44, for example, the effect of the present invention can be obtained. The position where the sheet conveyance apparatus 10 is mounted in the image forming apparatus 60, is not limited.

In this embodiment, since the sheet conveyance apparatus 10, which is in the condition illustrated in FIG. 1, is arranged in the position 500 in the image forming apparatus in FIG. 10, the lower guide ribs 5 guide a side of a sheet S opposite to a side on which a developer image has been fixed by the fixing unit 48. In this case, the sheet side on which the developer image is fixed refers to the sheet side on which a developer image is previously fixed, of the two sides. If the lower guide ribs 5 contact the sheet S immediately after a developer image is fixed, there is a danger that the image is damaged. However, by configuring the system as described in this embodiment, the image damage caused by the lower guide ribs 5 can be reduced.

Figure 11:
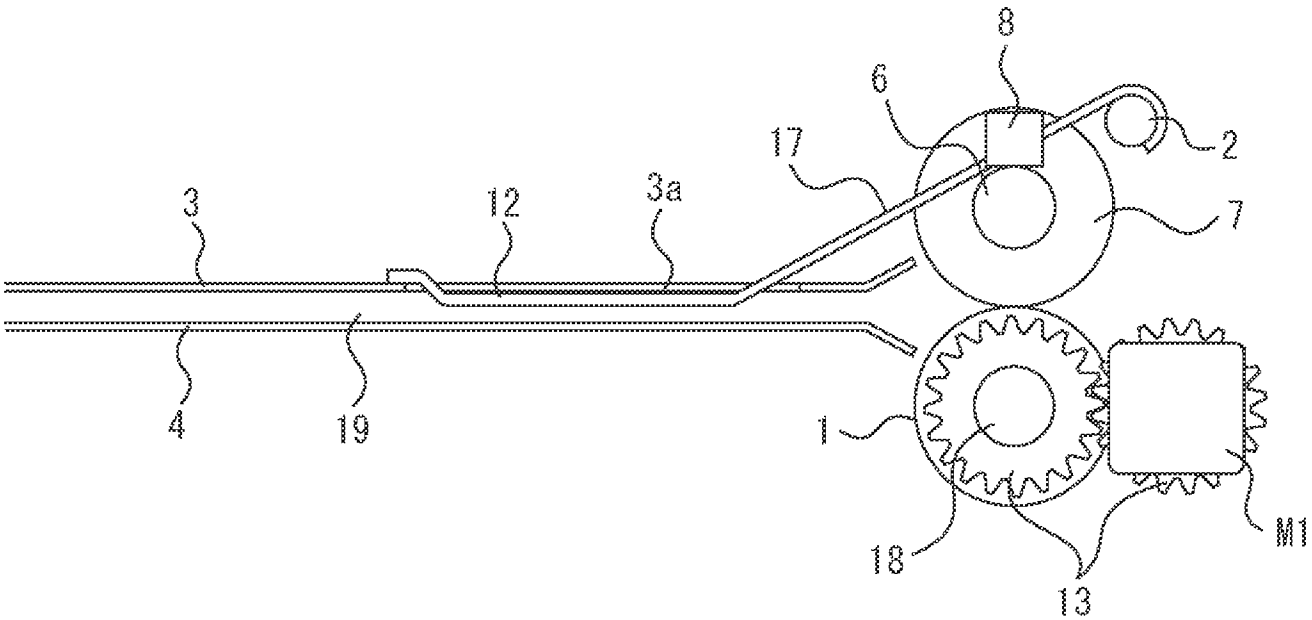
FIG. 11 is a sectional view of a modification of the sheet conveyance apparatus in FIG. 1.

For the above-described reasons, this first embodiment is configured as illustrated in FIG. 1. However, the upper guide ribs 12 may guide a sheet side on which a developer image is fixed by the fixing unit 48 as illustrated in FIG. 11, the effects of the present invention can be obtained. The upper guide ribs 12 may be configured just as illustrated in FIG. 5. Holes 3*a* similar to the holes 4*a* in FIG. 4 are slotted in the conveyance upper guide plate 3 to allow the upper guide ribs 12 to come into and out of the upper guide ribs 12 through the holes 3*a*.

A sheet conveyance apparatus 10 and an image forming apparatus 60 according to a second exemplary embodiment of the present invention are described with reference to FIGS. 7 to 9. Their basic structures are similar to those in the first exemplary embodiment, and descriptions of common structures are omitted as long as necessary.

Figure 7:
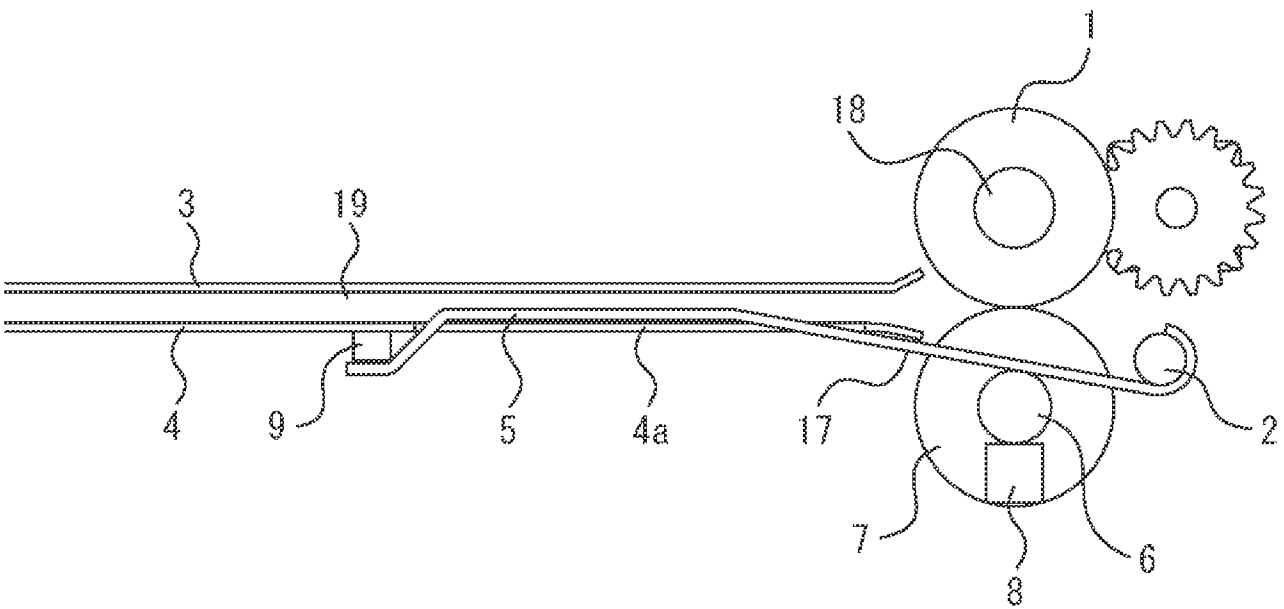
FIG. 7 is a sectional view of a second exemplary embodiment of the sheet conveyance apparatus according to the present invention.

In the second exemplary embodiment, as illustrated in FIG. 7, a damper 9, such as an air damper, is mounted between the end portion of the lower guide ribs 5 on the downstream side in the sheet conveyance direction and the surface of the conveyance lower guide plate 4 located outside of the sheet conveyance path 19. This damper 9 is set such that it expands or contracts according to a changing projecting amount of the lower guide ribs 5. The damper 9 has a larger load in the contraction direction of the damper 9 than a load in the expansion direction.

FIG. 7 illustrates the sheet conveyance apparatus 10 before a sheet S starts to pass. At this time, the damper 9 is in a state compressed in a direction from the lower guide ribs 5 toward the conveyance lower guide plate 4.

Figure 8:
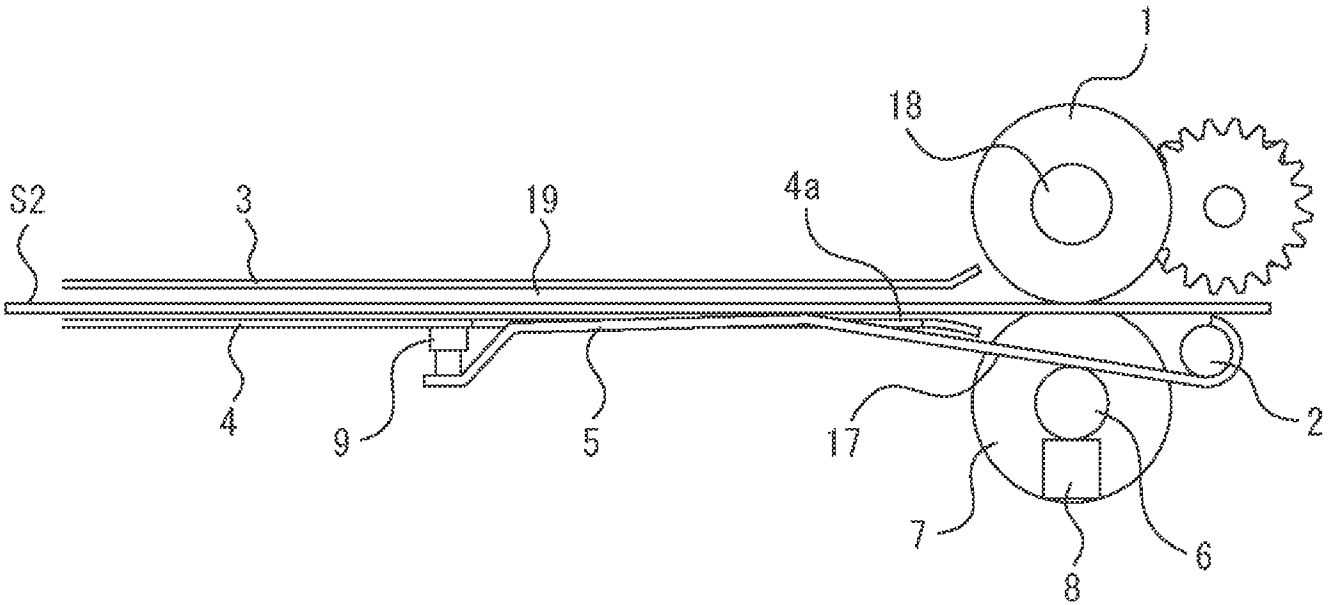
FIG. 8 is a diagram illustrating a state in which a thick sheet has been conveyed in the sheet conveyance path in the sheet conveyance apparatus in FIG. 7.
Figure 9:
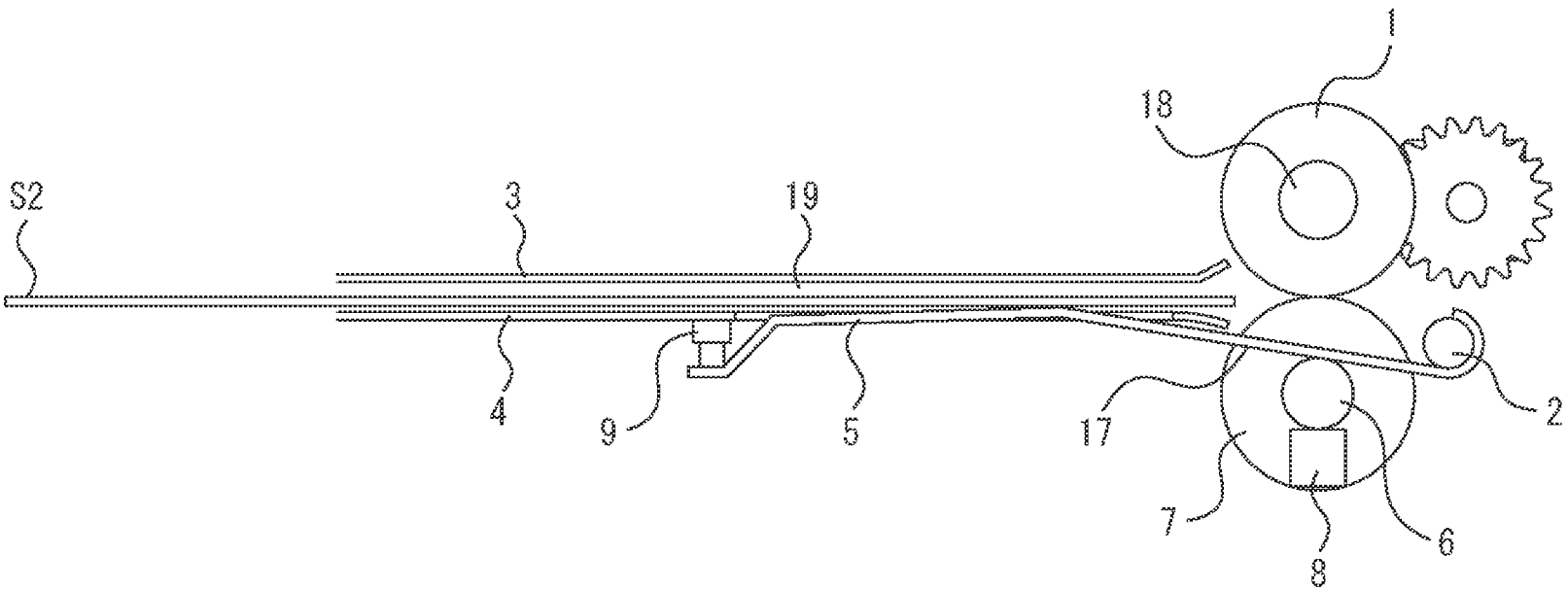
FIG. 9 is a diagram illustrating a state in which a thick sheet has passed through a pair of sheet conveyance rollers in the sheet conveyance apparatus in FIG. 7.

As illustrated in FIG. 8, when a thick sheet S2 is conveyed to between the pair of the sheet conveyance rollers 16, the driven roller 7 is moved in a direction of separating from the drive roller 1 by an amount of the thickness of the sheet S2. Accordingly, the lower guide ribs 5 are rotated, thus reducing their projecting amount in the sheet conveyance path 19. At this time, the damper 9 is in a state stretched in the direction of the lower guide ribs 5.

When the sheet S2 is further conveyed and has passed through the sheet conveyance roller pair 16, the driven roller 7 returns to the position where it was before the sheet S2 started to pass. On the other hand, the lower guide ribs 5 start to return to the position before the sheet S2 started to pass and the damper 9 is compressed. However, because the compression-direction load on the damper 9 is large, the return of the lower guide ribs 5 to the position where it was before the sheet S2 started to pass occurs later than the return of the driven roller 7 (FIG. 9).

Therefore, after the sheet S2 passes the pair of the sheet conveyance rollers 16 and when the sheet S2 is passing the sheet conveyance path 19, the lower guide ribs 5 have not returned to the position where it was before the sheet S2 started to pass. This reduces a possibility that a trailing edge of the sheet S2 is scratched by the lower guide ribs 5.

If a damper, designed such that load in the compression direction is smaller than load in the extension direction, is used for a damper 9, it may be configured such that the damper 9 is compressed when a sheet is conveyed through a pair of the sheet conveyance rollers 16.

Figure 12:
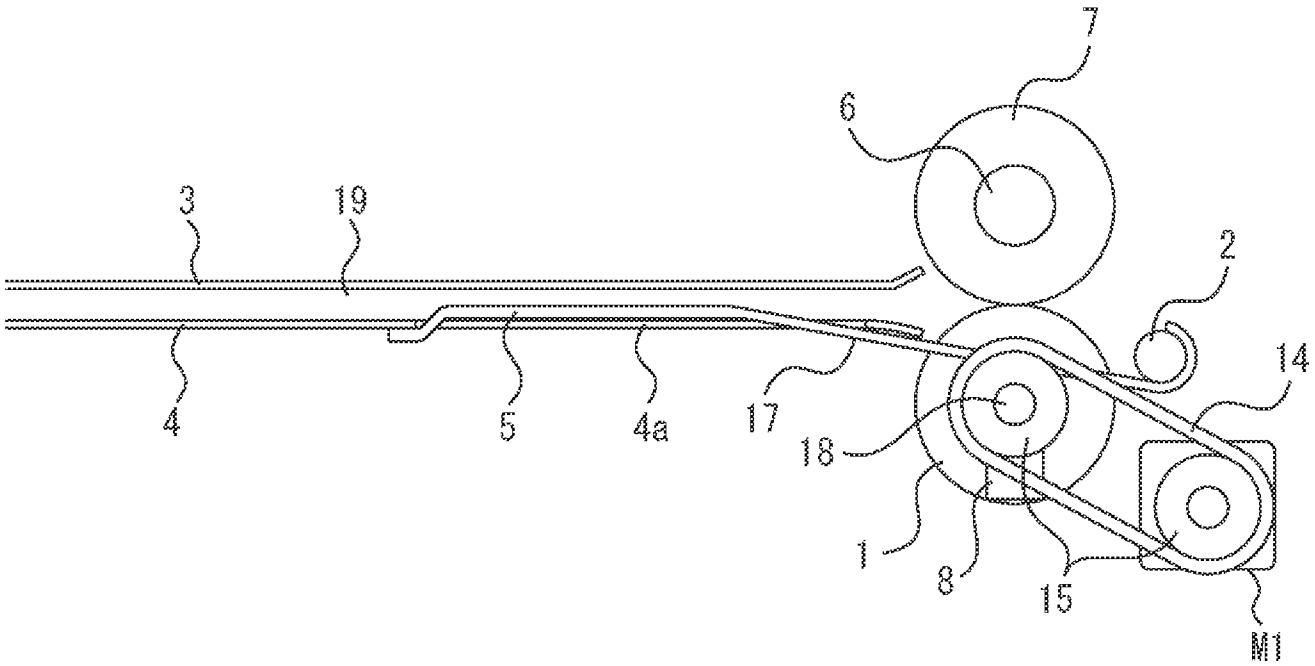
FIG. 12 is a sectional view of a third exemplary embodiment of the sheet conveyance apparatus of the present invention.

A third exemplary embodiment of the present invention is described below. The first and second embodiments are configured such that the projecting amount of the lower guide ribs 5 changes according to a positional change of the driven roller 7. As illustrated in FIG. 12, the driven roller 7 is used as the first roller, and the drive roller 1 as the second roller, and the projecting amount of the lower guide ribs 5 changes according to a positional change of the drive roller 1. In other words, in a sheet conveyance apparatus 10 in FIG. 12, the drive roller 1 can be displaced according to the position of the drive roller rotational axis 18, and the driven roller 7 is fixed by fixing the driven roller rotational axis 6. In this case, because the position of the drive roller 1 is changeable, a rotation drive force of the motor M1 is transmitted to the drive roller 1 by using a drive belt 14.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-090171 filed Apr. 2, 2009, which is hereby incorporated by reference herein in its entirety.

What is claimed is:

1. A sheet conveyance apparatus comprising:

a sheet conveyance roller pair, including an upper roller and a lower roller being urged to the upper roller by an elastic member, wherein the sheet conveyance roller pair conveys a sheet by nipping the sheet with the upper roller and the lower roller, and the position of the lower roller is changed according to a thickness of a sheet being conveyed by the sheet conveyance roller pair against an urging force of the elastic member;

an upper sheet guide plate and a lower sheet guide plate provided at a position on the downstream from the sheet conveyance roller pair in a sheet conveyance direction, wherein the upper sheet guide plate and the lower sheet guide plate form a sheet conveyance path therebetween;

a sheet guide rib provided on the downstream from the sheet conveyance roller pair in the sheet conveyance direction, wherein the sheet guide rib contacts the lower surface of the sheet conveyed by the sheet conveyance roller pair and can upwardly project into the sheet conveyance path from the lower sheet guide plate and the projecting amount thereof can be changed;

a lever provided with the sheet guide rib, wherein the lever extends along the sheet conveying direction; and a shaft which rotatably supports the lever and is provided on the upstream from a rotational center of the lower roller in the sheet conveyance direction, wherein the lever is engaged with the lower roller to rotate around the shaft in conjunction with the changing position of the lower roller such that the more thick a sheet nipped by the sheet conveyance roller pair is, the smaller the projecting amount of the sheet guide rib into the sheet conveyance path becomes.

2. The sheet conveyance apparatus according to claim 1, wherein the sheet guide rib can retract from inside the sheet conveyance path.

3. The sheet conveyance apparatus according to claim 1, further comprising:

a damper provided such that it extends or contracts according to changes in the projecting amount of the sheet guide rib, wherein when the sheet has passed the sheet conveyance roller pair, a return of the sheet guide rib to the position where it was before the sheet started to pass, occurs later than a return of the lower roller.

4. An image forming apparatus comprising:

a sheet feeding unit capable of feeding different types of sheets of different thickness;

an image forming section configured to form an image with a developer and transfer the image to a sheet fed from the sheet feeding unit;

a fixing unit configured to thermally fix the developer image transferred to the sheet; and the sheet conveyance apparatus according to claim 1, provided on the downstream from the fixing unit in the sheet conveyance direction.

5. An image forming apparatus according to claim 4, wherein the sheet guide rib contacts a side of the sheet on which the image is formed by the image forming section.

6. An image forming apparatus according to claim 4, wherein the sheet guide rib can retract from inside the sheet conveyance path.

7. An image forming apparatus according to claim 4, further comprising:

a damper provided such that it extends or contracts according to changes in the projecting amount of the sheet guide rib, wherein when the sheet has passed the sheet conveyance roller pair, a return of the sheet guide rib to the position where it was before the sheet started to pass, occurs later than a return of the lower roller.

8. A sheet conveyance apparatus comprising:

a sheet conveyance roller pair, including an upper roller and a lower roller being urged to the upper roller by an elastic member, wherein the sheet conveyance roller pair conveys a sheet by nipping the sheet with the upper roller and the lower roller, and the position of the lower roller is changed according to a thickness of a sheet being conveyed by the sheet conveyance roller pair against an urging force of the elastic member;

an upper sheet guide plate and a lower sheet guide plate provided at a position on the downstream from the sheet conveyance roller pair in a sheet conveyance direction, wherein the upper sheet guide plate and the lower sheet guide plate form a sheet conveyance path therebetween;

a sheet guide rib provided on the downstream from the sheet conveyance roller pair in the sheet conveyance direction, wherein the sheet guide rib contacts the lower surface of the sheet conveyed by the sheet conveyance roller pair and can upwardly project into the sheet conveyance path from the lower sheet guide plate and the position thereof relative to the upper and lower guide plate can be changed;

a lever provided with the sheet guide rib, wherein the lever extends along the sheet conveying direction; and an shaft which rotatably supports the lever and is provided on the upstream from a rotational center of the lower roller in the sheet conveyance direction, wherein the lever is engaged with the lower roller to rotate around the shaft in conjunction with the changing position of the lower roller such that the sheet guide rib moves in a direction retracting from the sheet conveyance path according to a moving of the lower roller away from the upper roller.

9. The sheet conveyance apparatus according to claim 8, wherein the sheet guide rib can retract from inside the sheet conveyance path.

10. The sheet conveyance apparatus according to claim 8, further comprising:

a damper provided such that it extends or contracts according to changes in the projecting amount of the sheet guide rib, wherein when the sheet has passed the sheet conveyance roller pair, a return of the sheet guide rib to the position where it was before the sheet started to pass, occurs later than a return of the lowers roller.

11. An image forming apparatus comprising:

a sheet feeding unit capable of feeding different types of sheets of different thickness;

an image forming section configured to form an image with a developer and transfer the image to a sheet fed from the sheet feeding unit;

a fixing unit configured to thermally fix the developer image transferred to the sheet; and the sheet conveyance apparatus according to claim 8, provided on the downstream from the fixing unit in the sheet conveyance direction.

12. An image forming apparatus according to claim 11, wherein the sheet guide rib contacts a side of the sheet on which the image is formed by the image forming section.

13. An image forming apparatus according to claim 11, wherein when the thickness of the sheet is larger than a predetermined thickness, the sheet guide rib retracts from inside the sheet conveyance path.

14. An image forming apparatus according to claim 11, further comprising:

a damper provided such that it extends or contracts according to changes in the projecting amount of the sheet guide rib, wherein when the sheet has passed the sheet conveyance roller pair, a return of the sheet guide rib to the position where it was before the sheet started to pass, occurs later than a return of the lower roller.

* * * * *